US011239594B2

(12) United States Patent
Shirai et al.

(10) Patent No.: US 11,239,594 B2
(45) Date of Patent: Feb. 1, 2022

(54) ELECTRICAL CONTACT MATERIAL, TERMINAL FITTING, CONNECTOR, AND WIRE HARNESS

(71) Applicants: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

(72) Inventors: Yoshimasa Shirai, Mie (JP); Yasushi Saito, Mie (JP); Kingo Furukawa, Mie (JP); Mitsuhiro Kumondai, Mie (JP); Akihisa Hosoe, Osaka (JP)

(73) Assignees: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

( * ) Notice: Subject to any disclaimer, the term of this patent is extended or adjusted under 35 U.S.C. 154(b) by 0 days.

(21) Appl. No.: 16/937,928

(22) Filed: Jul. 24, 2020

(65) Prior Publication Data

US 2021/0044046 A1 Feb. 11, 2021

(30) Foreign Application Priority Data

Aug. 5, 2019 (JP) ..... JP2019-143902

(51) Int. Cl.
*H01R 13/03* (2006.01)
*H01R 4/18* (2006.01)

(52) U.S. Cl.
CPC ..... *H01R 13/03* (2013.01); *H01R 4/185* (2013.01)

(58) Field of Classification Search
CPC ..... H01R 13/03; H01R 13/11; H01R 43/16; H01R 4/185; H01B 1/026
USPC ..... 439/886, 887
See application file for complete search history.

(56) References Cited

U.S. PATENT DOCUMENTS 4,994,435 A * 2/1991 Shiga ..... H01L 39/126 505/232
5,780,172 A * 7/1998 Fister ..... B32B 15/01 428/647
5,916,695 A * 6/1999 Fister ..... B32B 15/01 428/647
6,183,886 B1 * 2/2001 Chen ..... C23C 28/00 148/537

(Continued)

FOREIGN PATENT DOCUMENTS

JP 2015-67861 A 4/2015

*Primary Examiner* — Peter G Leigh
(74) *Attorney, Agent, or Firm* — Greenblum & Bernstein, P.L.C.

(57) ABSTRACT

The electrical contact material includes a base material, a coating layer provided on a surface of the base material, and an oxide layer provided on a surface of the coating layer. The base material contains Cu. The coating layer includes an undercoat layer, a first layer, and a second layer that are provided in that order from the base material side. The undercoat layer contains Ni. The first layer contains Ni, Zn, Cu, and Sn. The second layer contains Sn. The oxide layer is constituted by an oxide containing Zn, Cu, and Sn. The undercoat layer has a thickness larger than 0.5 μm.

9 Claims, 3 Drawing Sheets

(56) References Cited

U.S. PATENT DOCUMENTS

| | | | | |
|---|---|---|---|---|
| 6,770,383 | B2 * | 8/2004 | Tanaka | B32B 15/01 427/123 |
| 7,329,944 | B2 * | 2/2008 | Seki | H01L 23/49582 257/666 |
| 7,824,776 | B2 * | 11/2010 | Yoshida | B32B 15/01 428/647 |
| 8,142,906 | B2 * | 3/2012 | Taira | C25D 5/50 428/647 |
| 8,342,895 | B2 * | 1/2013 | Yoshida | C25D 5/10 439/886 |
| 9,263,814 | B2 * | 2/2016 | Yoshida | C25D 5/12 |
| 9,616,639 | B2 * | 4/2017 | Taninouchi | C25D 5/10 |
| 9,711,875 | B2 * | 7/2017 | Ooba | H01R 43/0207 |
| 10,047,448 | B2 * | 8/2018 | Kato | C23C 28/021 |
| 10,233,517 | B2 * | 3/2019 | Tsuru | C25D 7/00 |
| 2003/0186597 | A1 * | 10/2003 | Suzuki | H01R 13/03 439/886 |
| 2005/0037229 | A1 * | 2/2005 | Tanaka | C23C 28/021 428/647 |
| 2013/0255838 | A1 * | 10/2013 | Katsura | C22F 1/08 148/412 |
| 2015/0136456 | A1 * | 5/2015 | Bednarek | C22C 18/00 174/256 |
| 2015/0213918 | A1 * | 7/2015 | Shibuya | B32B 15/01 439/493 |
| 2016/0247592 | A1 * | 8/2016 | Sawada | C25D 5/50 |
| 2017/0044651 | A1 * | 2/2017 | Tsuru | C23C 28/023 |
| 2017/0085012 | A1 * | 3/2017 | Kayama | H01R 4/62 |
| 2018/0053714 | A1 * | 2/2018 | Foyet | C25D 3/50 |
| 2019/0161866 | A1 * | 5/2019 | Kubota | C25D 7/00 |

* cited by examiner

ELECTRICAL CONTACT MATERIAL, TERMINAL FITTING, CONNECTOR, AND WIRE HARNESS

TECHNICAL FIELD

The present disclosure relates to an electrical contact material, a terminal fitting, a connector, and a wire harness.

BACKGROUND ART

Patent Literature 1 discloses an electrical contact material for a connector that includes a diffusion barrier layer, an alloy layer, and an electrically-conductive film layer (oxide layer) that are provided on a surface of a base material in that order from the base material side. The base material is constituted by a metal material such as Cu (copper). The diffusion barrier layer is constituted by an Ni (nickel) plated layer having a thickness of about 0.5 μm, for example. The alloy layer contains Sn (tin) and Cu as essential elements and further contains one or more types of additive elements selected from a group consisting of Zn (zinc), Co (cobalt), Ni, and Pd (palladium). The electrically-conductive film layer is constituted by an oxide and the like that contains the constituent elements of the alloy layer.

CITATION LIST

Patent Literature

Patent Literature 1: JP 2015-067861A

SUMMARY OF INVENTION

Technical Problem

There is a demand for an electrical contact material that can be used for a long period of time.

Therefore, it is an object of the present disclosure to provide an electrical contact material, a terminal fitting, and a connector that can be used for a long period of time. It is another object of the present disclosure to provide a wire harness that has good electrical conductivity over a long period of time.

Solution to Problem

An electrical contact material according to the present disclosure includes:

a base material;

a coating layer that is provided on a surface of the base material; and an oxide layer that is provided on a surface of the coating layer, wherein the base material contains Cu, the coating layer includes an undercoat layer, a first layer, and a second layer that are provided in that order from the base material side, the undercoat layer contains Ni, the first layer contains Ni, Zn, Cu, and Sn, the second layer contains Sn, the oxide layer is constituted by an oxide containing Zn, Cu, and Sn, and the undercoat layer has a thickness larger than 0.5 μm.

A terminal fitting according to the present disclosure includes the electrical contact material according to the present disclosure.

A connector according to the present disclosure includes the terminal fitting according to the present disclosure.

A wire harness according to the present disclosure includes:

an electrical wire; and the terminal fitting or the connector according to the present disclosure, which is attached to the electrical wire.

Advantageous Effects of Invention

The electrical contact material according to the present disclosure, the terminal fitting according to the present disclosure, and the connector according to the present disclosure can be used for a long period of time.

The wire harness according to the present disclosure has good electrical conductivity over a long period of time.

BRIEF DESCRIPTION OF DRAWINGS

FIG. 3 is a diagram schematically illustrating a wire harness according to Embodiment 2.

DESCRIPTION OF EMBODIMENTS

Description of Embodiments of Present Disclosure

Figure 1:
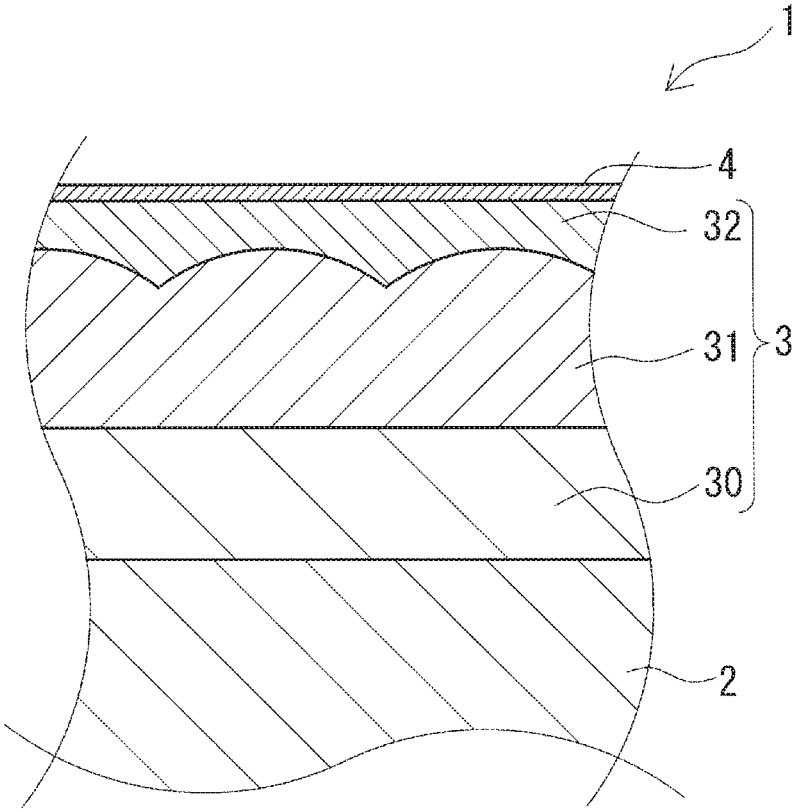
FIG. 1 is a cross-sectional view schematically illustrating an electrical contact material according to Embodiment 1.

First, aspects of implementation of the present disclosure will be listed and described.

(1) An electrical contact material according to one aspect of the present disclosure includes:

a base material;

a coating layer that is provided on a surface of the base material; and an oxide layer that is provided on a surface of the coating layer, wherein the base material contains Cu, the coating layer includes an undercoat, layer, a first layer, and a second layer that are provided in that order from the base material side, the undercoat layer contains Ni, the first layer contains Ni, Zn, Cu, and Sn, the second layer contains Sn, the oxide layer is constituted by an oxide containing Zn, Cu, and Sn, and the undercoat layer has a thickness larger than 0.5 μm.

The above-described electrical contact material can be used for a long period of time. This is because the above-described electrical contact material has a low contact resistance with respect to a counterpart material even if the electrical contact material is exposed to a high-temperature environment for a long period of time in an accelerated aging test. That is, the above-described electrical contact material has good heat resistance. Reasons for the good heat resistance include the undercoat layer being thick as described below, and it is also considered that the first layer containing the above-described four elements contributes to the good heat resistance although details of this are not made clear.

When heat acts on the electrical contact material, the thick undercoat layer is likely to suppress diffusion of Cu contained in the base material toward the oxide layer. Accordingly, an oxide of Cu that increases contact resistance is unlikely to be increased in the oxide layer. Therefore, an increase in the contact resistance is suppressed in the oxide layer. That is, the oxide layer has a low resistance, and can easily ensure the electrical conductivity. Therefore, even if heat acts on the above-described electrical contact material, the electrical contact material can ensure a favorable electrical connection with a counterpart material via the electrically-conductive oxide layer and the coating layer.

Furthermore, as a result of the undercoat layer being thick, it can be ensured that the above-described electrical contact material includes the first layer containing the above-described four elements, as described later in detail.

Furthermore, oxidation of the base material is likely to be suppressed in the above-described electrical contact material. This is because the electrical contact material includes the above-described coating layer having a three-layer structure and the above-described oxide layer.

Also, the above-described electrical contact material can ensure a favorable electrical connection with a counterpart material even if the pressure of contact with the counterpart material is small and a load applied to the electrical contact material when in use is small. This is because the above-described oxide layer has a low resistance and can easily ensure the electrical conductivity. Therefore, the above-described electrical contact material can ensure a favorable electrical connection with the counterpart material via the electrically-conductive oxide layer and the coating layer.

(2) The above-described electrical contact material may have a configuration in which contents of Ni, Zn, Cu, and Sn contained in the first layer are such that Ni is from 15 atom % to 35 atom % inclusive, Zn is from 5 atom % to 30 atom % inclusive, Cu is from 1 atom % to 30 atom % inclusive, and Sn is from 25 atom % to 55 atom % inclusive, wherein the total content of C, O, Ni, Zn, Cu, and Sn contained in the first layer is 100 atom %

If the contents of the above-described four elements in the first layer are within the above-described ranges, the above-described electrical contact material has more improved heat resistance.

(3) The above-described electrical contact material may have a configuration in which the first layer has a thickness of 0.1 μm to 5.0 μm inclusive.

If the thickness of the first layer is at least 0.1 μm, the electrical contact material has good heat resistance. This is because the first layer is sufficiently thick. Oxidation of the base material is likely to be suppressed with this first layer. This is because the coating layer is likely to be thick as a result of the first layer being sufficiently thick.

If the thickness of the first layer is not larger than 5.0 μm, the electrical contact material can be produced with high productivity. This is because a time for forming the first layer can be reduced since the first layer is not too thick, and consequently a time for forming the coating layer can be reduced.

(4) The above-described electrical contact material may have a configuration in which the second layer has a thickness of 0.1 μm to 0.55 μm inclusive.

If the thickness of the second layer is at least 0.1 μm, the electrical contact material has good heat resistance. This is because the second layer is not too thin. This second layer is likely to suppress diffusion of Cu contained in the first layer toward the oxide layer when heat acts on the electrical contact material. Accordingly an oxide of Cu that increases the contact resistance is unlikely to be increased in the oxide layer, and an increase in the contact resistance can be suppressed in the oxide layer, as described above. Therefore, even if heat acts on the above-described electrical contact material, the electrical contact material can ensure a favorable electrical connection with a counterpart material. Oxidation of the base material is likely to be suppressed with this second layer. This is because the coating layer is likely to be thick as a result of the second layer being not too thin.

If the thickness of the second layer is not larger than 0.55 μm, an increase in the contact resistance is likely to be suppressed even if the electrical contact material slides against a counterpart material when in use. That is, the electrical contact material has good wear resistance as a result of including the second layer. This is because the second layer is sufficiently thin. If the second layer is sufficiently thin, even if the second layer slides against the counterpart material, the formation of a large amount of powder of an oxide containing a constituent material of the second layer is likely to be suppressed. Accordingly it is possible to suppress a situation in which the powder of the oxide is caught between the electrical contact material and the counterpart material at a position of contact therebetween. Therefore, the above-described electrical contact material can ensure a favorable electrical connection with the counterpart material even if the electrical contact material slides against the counterpart material.

(5) The above-described electrical contact material may have a configuration in which the oxide layer has a thickness of 0.01 μm to 5.0 μm inclusive.

If the thickness of the oxide layer is at least 0.1 μm, the base material is unlikely to be oxidized. This is because the oxide layer is sufficiently thick.

If the thickness of the oxide layer is not larger than 5.0 μm, the oxide layer has a low contact resistance. This is because the oxide layer is not too thick. Therefore, the electrical contact material including the oxide layer can ensure a more favorable electrical connection with a counterpart material.

(6) A terminal fitting according to one aspect of the present disclosure includes the electrical contact material according to any one of the above-described (1) to (5).

With this configuration, good heat resistance can be achieved as a result of including the above-described electrical contact material.

(7) A connector according to one aspect of the present disclosure includes the terminal fitting according to the above-described (6).

With this configuration, good heat resistance can be achieved as a result of including the above-described terminal fitting.

(8) A wire harness according to one aspect of the present disclosure includes:

an electrical wire; and the terminal fitting according to the above-described (6) or the connector according to the above-described (7), the terminal fitting or the connector being attached to the electrical wire.

With this configuration, the above-described terminal fitting or the terminal fitting of the above-described connector can be favorably electrically connected to the electrical wire even if heat acts on the wire harness, and therefore good electrical conductivity can be achieved.

Details of Embodiments of Present Disclosure

Embodiments of the present disclosure will be described in detail below. The same reference numerals in the drawings denote elements of the same name.

Embodiment 1

[Electrical Contact Material]

An electrical contact material 1 according to Embodiment 1 will be described with reference to FIG. 1. The electrical contact material 1 according to the present embodiment includes a base material 2, a coating layer 3, and an oxide layer 4. The base material 2 contains Cu. One of the characteristics of the electrical contact material 1 according to the present embodiment is the following points (1) to (3).

(1) The coating layer 3 includes an undercoat layer 30, a first layer 31, and a second layer 32 that are made of specific materials and provided on a surface of the base material 2 in that order from the base material 2 side.

(2) The undercoat layer 30 has a specific thickness.

(3) The oxide layer 4 is constituted by a specific material.

Hereinafter, each configuration will be described in detail. FIG. 1 shows a cross-sectional view taken along a layered direction of the coating layer 3 and the oxide layer 4 in the electrical contact material 1. Thicknesses of the layers from the undercoat layer 30 to the second layer 32 of the coating layer 3 and the thickness of the oxide layer 4 shown in FIG. 1 are schematically shown and do not necessarily correspond to actual thicknesses.

[Base Material]

The base material 2 is constituted by pure Cu or a Cu alloy The base material 2 has good electrical conductivity as a result of containing Cu. Various shapes such as a plate shape or a rod shape can be appropriately selected as the shape of the base material 2. Various dimensions can be appropriately selected as the size of the base material 2 depending on the use of the electrical contact material 1.

[Coating Layer]

The coating layer 3 suppresses oxidation of the base material 2. The coating layer 3 is provided on a surface of the base material 2. The coating layer 3 has a three-layer structure constituted by the undercoat layer 30, the first layer 31, and the second layer 32.

(Undercoat Layer)

The undercoat layer 30 is provided on the innermost side of the coating layer 3, i.e., directly on the base material 2. The undercoat layer 30 contains Ni. The undercoat layer 30 may contain, for example, one or more types of elements selected from a group consisting of Zn, Cu, and Sn, as elements other than Ni. The Ni content in the undercoat layer 30 is larger than Ni contents in the first layer 31 and the second layer 32. When the total content of Ni, Zn, Cu, and Sn contained in the undercoat layer 30 is 100 atom %, the Ni content in the undercoat layer 30 may be 95 atom % or more, for example. The Ni content in the undercoat layer 30 may be 100 atom % or less. The Ni content in the undercoat layer 30 may be preferably from 97 atom % to 100 atom % inclusive, more preferably from 98 atom % to 100 atom % inclusive, and further preferably from 99 atom % to 100 atom % inclusive, Contents of elements contained in the undercoat layer 30 can be measured using an energy dispersive X-ray fluorescence spectroscopy (EDX) apparatus with the acceleration voltage of the EDX apparatus set to 15 kV.

The thickness of the undercoat layer 30 is larger than 0.5 μm. As a result of the undercoat layer 30 having a thickness larger than 0.5 μm, the electrical contact material 1 can be used over a long period of time. This is because the electrical contact material 1 has a low contact resistance with respect to a counterpart material even if the electrical contact material 1 is exposed to a high-temperature environment for a long period of time in an accelerated aging test. That is, the electrical contact material 1 has good heat resistance. As a result of the undercoat layer 30 being thick, diffusion of Cu contained in the base material 2 toward the oxide layer 4 is likely to be suppressed when heat acts on the electrical contact material. Accordingly, an oxide of Cu that increases the contact resistance is unlikely to be increased in the oxide layer 4. Therefore, an increase in the contact resistance is suppressed in the oxide layer 4. That is, the oxide layer 4 has a low resistance, and can easily ensure the electrical conductivity. Therefore, even if heat acts on the electrical contact material 1, the electrical contact material 1 can ensure a favorable electrical connection with a counterpart material via the electrically-conductive oxide layer 4 and the coating layer 3. Furthermore, as a result of the undercoat layer 30 having a thickness larger than 0.5 μm, it can be ensured that the coating layer 3 includes the first layer 31 containing specific elements described below, as described later in detail in a description of a manufacturing method.

The thicker the undercoat layer 30 is, the higher the heat resistance is, and the more reliably the coating layer 3 can include the first layer 31. The thickness of the undercoat layer 30 may be preferably at least 1.0 μm, and more preferably at least 1.5 μm. The upper limit of the thickness of the undercoat layer 30 may be 4.0 μm, for example. If the thickness of the undercoat layer 30 is not larger than 4.0 μm, the electrical contact material 1 can be produced with high productivity. This is because a time for forming the undercoat layer 30 can be reduced since the undercoat layer 30 is not too thick, and consequently a time for forming the coating layer 3 can be reduced.

The thickness of the undercoat layer 30 can be measured as described below by using a scanning electron microscope (SEM). A cross section is arbitrarily taken along the layered direction of the coating layer 3 and the oxide layer 4 in the electrical contact material 1. The number of cross sections may be one or more. At least two backscattered electron images are taken from the one or more cross sections. All of the backscattered electron images may be taken from a single cross section or at least one backscattered electron image may be taken from each of a plurality of cross sections. Each backscattered electron image has a size of 30 μm×40 μm. The length of the undercoat layer 30 along the layered direction of the coating layer 3 is measured at at least five positions in each backscattered electron image. An average of all of the measured lengths of the undercoat layer 30 is calculated. This average is taken to be the thickness of the undercoat layer 30.

(First Layer)

The first layer 31 is provided between the undercoat layer 30 and the second layer 32. The first layer 31 contains four elements, i.e., Ni, Zn, Cu, and Sn. It is thought that the first layer 31 containing these four elements contributes to suppression of an increase in the contact resistance even if heat acts on the electrical contact material 1. That is, the electrical contact material 1 has good heat resistance as a result of including the first layer 31. These four elements may be present in any form. For example, these elements may be present in the form of single metal, an alloy a compound, a complex of single metal and a compound, or a complex of an alloy and a compound. The above-described alloy is only required to contain at least two elements selected from a group consisting of the above-described four elements. Of course, the above-described alloy may also contain all of the above-described four elements. The above-described compound is only required to contain at least one element selected from the above-described four elements. The first layer 31 may contain C (carbon) and O (oxygen) in addition to the above-described four elements.

When the total content of C, O, Ni, Zn, Cu, and Sn contained in the first layer 31 is 100 atom %, respective contents of Ni, Zn, Cu, and Sn contained in the first layer 31 are as follows, for example. The Ni content may be from 15 atom % to 35 atom % inclusive. The Zn content may be from 5 atom % to 30 atom % inclusive. The Cu content may be from 1 atom % to 30 atom % inclusive. The Sn content may be from 25 atom % to 55 atom % inclusive. If the contents of the above-described four elements contained in the first layer 31 are within the above-described ranges, the electrical contact material 1 has good heat resistance. The Ni content may be preferably from 17 atom % to 33 atom % inclusive, and more preferably from 20 atom % to 30 atom % inclusive. The Zn content may be preferably from 7 atom % to 25 atom % inclusive, and more preferably from 10 atom % to 20 atom % inclusive. The Cu content may be preferably from 5 atom % to 28 atom % inclusive, and more preferably from 10 atom % to 25 atom % inclusive. The Sn content may be preferably from 30 atom % to 50 atom % inclusive, and more preferably from 35 atom % to 45 atom % inclusive. The contents of the elements contained in the first layer 31 are measured using the same method as the measurement method used for the undercoat layer 30.

The thickness of the first layer 31 may be from 0.1 μm to 5.0 μm inclusive, for example. If the thickness of the first layer 31 is at least 0.1 μm, the electrical contact material 1 has good heat resistance. This is because the first layer 31 is sufficiently thick. Oxidation of the base material 2 is likely to be suppressed with this first layer 31. This is because the coating layer 3 is likely to be thick. If the thickness of the first layer 31 is not larger than 5.0 μm, the electrical contact material 1 can be produced with high productivity. This is because a time for forming the first layer 31 can be reduced since the first layer 31 is not too thick, and consequently a time for forming the coating layer 3 can be reduced. The thickness of the first layer 31 may be preferably from 0.5 μm to 4.5 μm inclusive, more preferably from 1.0 μm to 3.5 μm inclusive, and further preferably from 1.5 μm to 2.5 μm inclusive. The thickness of the first layer 31 is determined using the same method as the method for determining the thickness of the undercoat layer 30.

(Second Layer)

The second layer 32 is provided on the outermost side of the coating layer 3, i.e., beneath the oxide layer 4. The second layer 32 contains Sn. The second layer 32 may contain, for example, one or more types of elements selected from a group consisting of Ni, Zn, and Cu, as elements other than Sn. Further, the second layer 32 may contain C and O in addition to the above-described four elements. The Sn content in the second layer 32 is larger than Sn contents in the undercoat layer 30 and the first layer 31. When the total content of C, O, Ni, Zn, Cu, and Sn contained in the second layer 32 is 100 atom %, the Sn content in the second layer 32 may be 40 atom % or more, for example. The Sn content in the second layer 32 may be 90 atom % or less. The Sn content in the second layer 32 may be preferably from 45 atom % to 80 atom % inclusive, and more preferably from 50 atom % to 75 atom % inclusive. Contents of elements contained in the second layer 32 are measured using the same method as the measurement method used for the undercoat layer 30.

The thickness of the second layer 32 may be from 0.1 μm to 0.55 μm inclusive, for example. If the thickness of the second layer 32 is at least 0.1 μm, the electrical contact material 1 has good heat resistance. This is because the second layer 32 is not too thin. The second layer 32 is likely to suppress diffusion of Cu contained in the first layer 31 toward the oxide layer 4 when heat acts on the electrical contact material. Accordingly an oxide of Cu that increases the contact resistance is unlikely to be increased in the oxide layer 4, and an increase in the contact resistance can be suppressed in the oxide layer 4. That is, the oxide layer 4 has a low resistance, and can easily ensure the electrical conductivity. Therefore, even if heat acts on the electrical contact material 1, the electrical contact material 1 can ensure a favorable electrical connection with a counterpart material via the electrically-conductive oxide layer 4 and the coating layer 3. Furthermore, oxidation of the base material 2 is likely to be suppressed with the second layer 32. This is because the coating layer 3 is likely to be thick as a result of the second layer 32 being not too thin.

If the thickness of the second layer 32 is not larger than 0.55 μm, an increase in the contact resistance is likely to be suppressed even if the electrical contact material 1 slides against a counterpart material. That is, the electrical contact material 1 has good wear resistance as a result of including the second layer 32. This is because the second layer 32 is sufficiently thin. If the second layer 32 is sufficiently thin, even if the second layer 32 slides against the counterpart material, the formation of a large amount of powder of an oxide containing a constituent material of the second layer 32 can be suppressed. Accordingly it is possible to suppress a situation in which the powder of the oxide is caught between the electrical contact material 1 and the counterpart material at a position of contact therebetween. The electrical contact material 1 can ensure a favorable electrical connection with the counterpart material even if the electrical contact material 1 slides against the counterpart material. A thinner second layer 32 further contributes to an improvement in the wear resistance.

The thickness of the second layer 32 may be preferably from 0.13 μm to 0.54 μm inclusive, more preferably from 0.13 μm to 0.50 μm inclusive, further preferably from 0.13 μm to 0.40 μm inclusive, and particularly preferably from 0.13 μm to 0.30 μm inclusive. The thickness of the second layer 32 is determined using the same method as the method for determining the thickness of the undercoat layer 30.

[Oxide Layer]

The oxide layer 4 is provided on a surface of the coating layer 3. That is, the oxide layer 4 constitutes the outermost surface of the electrical contact material 1. The oxide layer 4 is constituted by an oxide containing Zn, Cu, and Sn. For example, oxides such as ZnO, SnO, $SnO_2$, CuO, and $CuO_2$ may be present together in the oxide layer 4. The oxide layer 4 may also contain a compound formed from any of the above-described oxides. For example, the oxide layer 4 may also contain (Zn, Cu) O or (Zn, Sn) O, which is formed as a result of a portion of Zn in ZnO being substituted by Cu or Sn. The amount of an oxide of Cu contained in the oxide layer 4 is smaller than amounts of other oxides contained in the oxide layer 4. Specifically the amount of an oxide of Cu contained in the oxide layer 4 is smaller than the amount of an oxide of Zn contained in the oxide layer 4. The oxide layer 4 containing a small amount of the oxide of Cu has a low resistance, and can easily ensure the electrical conductivity.

When the total content of four elements contained in the oxide layer 4, i,e., O, Zn, Cu, and Sn, is 100 atom %, respective contents of the four elements are as follows, for example. The O content may be larger than 0 atom % and not larger than 70 atom %. The Zn content may be larger than 0 atom % and not larger than 70 atom %. The Cu content may be larger than 0 atom % and not larger than 30 atom %. The Sn content may be larger than 0 atom % and not larger than 30 atom %. If the contents of the elements are within the above-described ranges, the oxide layer 4 is likely to improve electrical conductivity. Furthermore, oxidation of the base material 2 is likely to be suppressed. The O content may be preferably from 0.1 atom % to 60 atom % inclusive. The Zn content may be preferably from 0.1 atom % to 60 atom % inclusive. The Cu content may be preferably from 0.1 atom % to 20 atom % inclusive. The Sn content may be preferably from 0.1 atom % to 20 atom % inclusive. The composition of the oxide layer 4 is determined using an EDX apparatus as is the case with the undercoat layer 30.

The thickness of the oxide layer 4 may be from 0.01 μm to 5.0 μm inclusive, for example. If the thickness of the oxide layer 4 is at least 0.01 μm, the base material 2 is unlikely to be oxidized. This is because the oxide layer 4 is sufficiently thick. If the thickness of the oxide layer 4 is not larger than 5.0 μm, the oxide layer 4 has a low contact resistance. This is because the oxide layer 4 is not too thick. Accordingly, the electrical contact material 1 including the oxide layer 4 can ensure a more favorable electrical connection with a counterpart material via the electrically-conductive oxide layer 4 and the coating layer 3. The thickness of the oxide layer 4 may be preferably from 0.02 μm to 3.0 μm inclusive, and more preferably from 0.03 μm to 1.0 μm inclusive. The thickness of the oxide layer 4 is determined using the same method as the method for determining the thickness of the undercoat layer 30.

[Characteristics]

The electrical contact material 1 preferably has a low contact resistance after a sliding test. The sliding test is performed by linearly sliding a gold-plated spherical indenter with a radius of 1 mm against, the electrical contact material 1. The purity of gold used for plating is substantially K24. The thickness of the gold plating is 0.4 μm. The indenter is slid in a normal-temperature environment. A load of 1 N is applied via the indenter. The sliding speed is 100 μm/sec. The stroke is 50 μm. The number of reciprocation cycles is 10 or 100. The contact resistance is measured after each reciprocation cycle. The number of measurements (N number) is two. The largest contact resistance of the electrical contact material 1 when the number of reciprocation cycles is 10 is preferably not larger than 5 mΩ. Such an electrical contact material 1 has good wear resistance. Therefore, the electrical contact material 1 can be favorably used as a member that slides against a counterpart material. The largest contact resistance of the electrical contact material 1 is more preferably not larger than 3 mΩ, and further preferably not larger than 2.5 mΩ. The largest contact resistance of the electrical contact material 1 when the number of reciprocation cycles is 100 is also preferably not larger than 5 mΩ. Such an electrical contact material 1 has more improved wear resistance. Therefore, the electrical contact material 1 can be used for a long period of time as a member that slides against a counterpart material. The largest contact resistance of the electrical contact material 1 is more preferably not larger than 4.5 mΩ, and further preferably not larger than 4.0 mΩ.

[Manufacturing Method]

Figure 2:
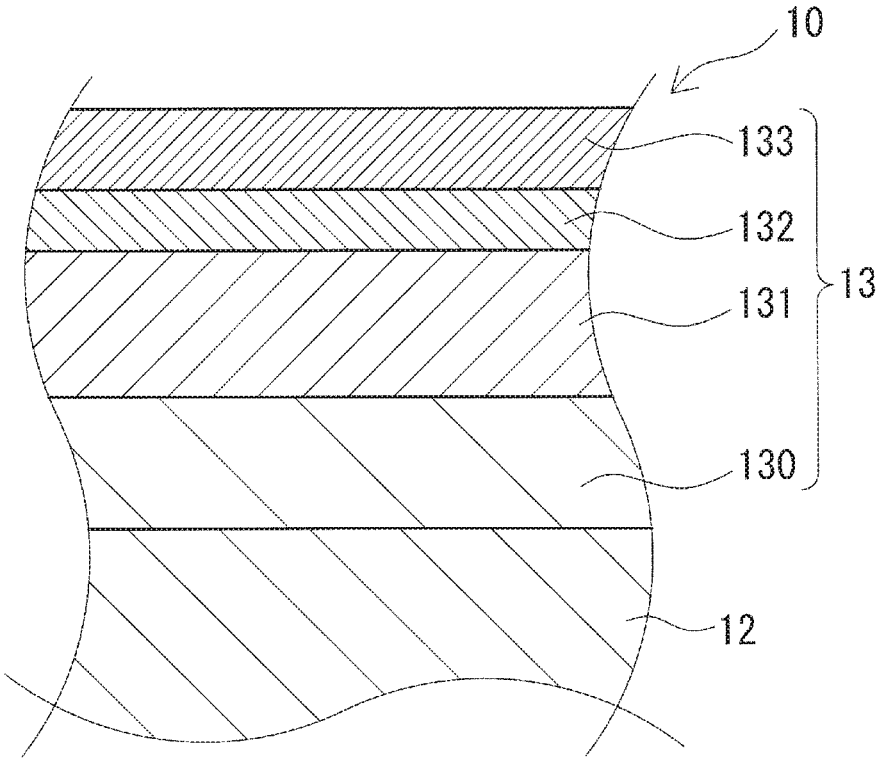
FIG. 2 is a diagram illustrating a method for manufacturing the electrical contact material according to Embodiment 1.
Figure 8:
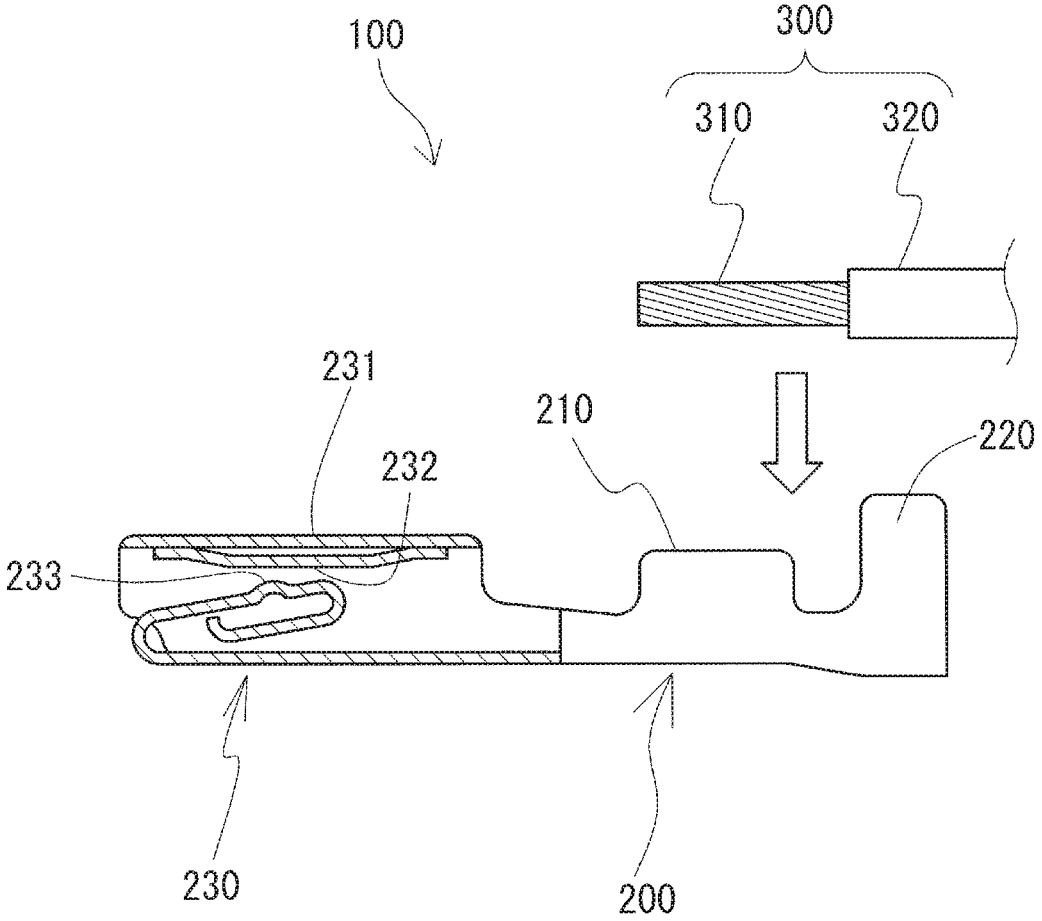

A method for manufacturing an electrical contact material through which the electrical contact material 1 according to the present embodiment is manufactured will be described with reference to FIG. 2. FIG. 2 shows a cross section of a raw material 10 of the electrical contact material 1 taken along a layered direction of a coating layer 13. The method for manufacturing an electrical contact material includes a step S1 for preparing the raw material 10 and a step S2 for performing thermal treatment on the raw material 10.

(Step S1)

The raw material 10 to be prepared includes a base material 12 and the coating layer 13. The base material 12 corresponds to the base material 2 in the above-described electrical contact material 1. The coating layer 13 has a four-layer structure constituted by an undercoat raw material layer 130, a first raw material layer 131, a second raw material layer 132, and a third raw material layer 133 that are provided on a surface of the base material 12 in that order from the base material 12 side.

<Undercoat Raw Material Layer>

The undercoat raw material layer 130 forms the undercoat layer 30 of the above-described electrical contact material 1 after thermal treatment, which will be described later. The undercoat raw material layer 130 is constituted by pure Ni or an Ni alloy. The Ni alloy may contain, for example, one or more types of elements selected from a group consisting of Sn, Zn, and Cu as additive elements, in addition to Ni. The thickness of the undercoat raw material layer 130 is set such that the thickness of the undercoat layer 30 after the thermal treatment is larger than 0.5 μm. The undercoat layer 30 after the thermal treatment is likely to be thinner than the undercoat raw material layer 130 before the thermal treatment. Therefore, the undercoat raw material layer 130 is made thicker than the undercoat layer 30 of the electrical contact material 1. The thickness of the undercoat raw material layer 130 may be at least 0.6 μm, for example. If the thickness of the undercoat raw material layer 130 is at least 0.6 μm, Cu contained in the base material 12 is likely to be kept from diffusing toward a surface of the coating layer 13 due to thermal treatment. If diffusion of Cu can be suppressed, reliable formation of the first layer 31 containing the above-described specific elements is facilitated. Furthermore, the formation of the above-described oxide layer 4 having a small Cu content is facilitated. The thicker the undercoat raw material layer 130 is, the more reliably these effects can be achieved. The thickness of the undercoat raw material layer 130 may be preferably at least 0.7 μm, and more preferably at least 1.0 μm. The upper limit of the thickness of the undercoat raw material layer 130 may be about 4.0 μm, for example.

<First Raw Material Layer>

The first raw material layer 131 mainly forms the second layer 32 of the above-described electrical contact material 1 after the thermal treatment described below A portion of the first raw material layer 131 forms the first layer 31 of the above-described electrical contact material 1 after the thermal treatment described below.

The first raw material layer 131 is constituted by pure Sn or an Sn alloy. The Sn alloy may contain, for example, one or more types of elements selected from a group consisting of Cu and Zn as additive elements, in addition to Sn. The Sn content in the first raw material layer 131 is larger than Sn contents in the second raw material layer 132 and the third raw material layer 133. When the total content of C, O, Ni, Zn, Cu, and Sn contained in the first raw material layer 131 is 100 atom %, the Sn content in the first raw material layer 131 may be 90 atom % or more, for example. The Sn content in the first raw material layer 131 may be 100 atom % or less. The Sn content in the first raw material layer 131 may be preferably from 95 atom % to 100 atom % inclusive, more preferably from 98 atom % to 100 atom % inclusive, and further preferably from 99 atom % to 100 atom % inclusive.

The thickness of the first raw material layer 131 affects the thickness of the second layer 32 of the electrical contact material 1 to be obtained. The thickness of the first raw material layer 131 may be from 0.5 μm to 5.0 μm inclusive, for example. If the thickness of the first raw material layer 131 is at least 0.5 μm, the first raw material layer 131 is likely to suppress diffusion of Cu contained in the base material 12 toward the surface of the coating layer 13. Furthermore, if the thickness of the first raw material layer 131 is at least 0.5 μm, the second layer 32 of the electrical contact material 1 is likely to have a thickness of at least 0.1 μm. If the thickness of the first raw material layer 131 is not larger than 5.0 μm, the second layer 32 of the electrical contact material 1 is likely to have a thickness not larger than 0.55 μm. Furthermore, if the thickness of the first raw material layer 131 is not larger than 5.0 μm, a time for forming the coating layer 13 can be easily reduced. The thickness of the first raw material layer 131 may be preferably from 0.5 μm to 3.0 μm inclusive.

<Second Raw Material Layer>

The second raw material layer 132 mainly forms the oxide layer 4 of the above-described electrical contact material 1 after the thermal treatment described below. A portion of the second raw material layer 132 forms the first layer 31 of the above-described electrical contact material 1 after the thermal treatment described below.

The second raw material layer 132 is constituted by pure Zn or a Zn alloy. The Zn alloy may contain Sn as an additive element, in addition to Zn. The Zn content in the second raw material layer 132 is larger than the Zn content in the first raw material layer 131. When the total content of C, O, Ni, Zn, Cu, and Sn contained in the second raw material layer 132 is 100 atom %, the Zn content in the second raw material layer 132 may be 90 atom % or more, for example. The Zn content in the second raw material layer 132 may be 100 atom % or less. The Zn content in the second raw material layer 132 may be preferably from 95 atom % to 100 atom % inclusive, and more preferably from 99 atom % to 100 atom % inclusive.

The thickness of the second raw material layer 132 may be from 0.1 μm to 1.0 μm inclusive. If the thickness of the second raw material layer 132 is at least 0.1 μm, the second raw material layer 132 is likely to suppress diffusion of Cu contained in the base material 12 toward the surface of the coating layer 13. Furthermore, the formation of the above-described oxide layer 4 is facilitated. If the thickness of the second raw material layer 132 is not larger than 1.0 μm, the oxide layer 4 is more likely to contain Sn and Zn. Furthermore, the oxide layer 4 is less likely to contain Cu. The thickness of the second raw material layer 132 may be preferably from 0.1 μm to 0.5 μm inclusive, and more preferably from 0.2 μm to 0.4 μm inclusive.

<Third Raw Material Layer>

The third raw material layer 133 mainly forms the first layer 31 of the above-described electrical contact material 1 after the thermal treatment described below. A portion of the third raw material layer 133 forms the oxide layer 4 of the above-described electrical contact material 1 after the thermal treatment described below The third raw material layer 133 is the outermost layer of the coating layer 13. The third raw material layer 133 is constituted by pure Cu or a Cu alloy The Cu alloy may contain Sn as an additive element, in addition to Cu. The Cu content in the third raw material layer 133 is larger than the Cu content in the first raw material layer 131. When the total content of C, O, Ni, Zn, Cu, and Sn contained in the third raw material layer 133 is 100 atom %, the Cu content in the third raw material layer 133 may be 90 atom % or more, for example. The Cu content in the third raw material layer 133 may be 100 atom % or less. The Cu content in the third raw material layer 133 may be preferably from 95 atom % to 100 atom % inclusive, and more preferably from 99 atom % to 100 atom % inclusive.

The thickness of the third raw material layer 133 may be from 0.1 μm to 1.0 μm inclusive, for example. If the thickness of the third raw material layer 133 is at least 0.1 μm, the formation of the above-described oxide layer 4 is facilitated. If the thickness of the third raw material layer 133 is not larger than 1.0 μm, the oxide layer 4 of the electrical contact material 1 is more likely to contain Sn and Zn. Also, the oxide layer 4 of the electrical contact material 1 is less likely to contain Cu. The thickness of the third raw material layer 133 may be preferably from 0.1 μm to 0.5 μm inclusive, and more preferably from 0.2 μm to 0.4 μm inclusive.

Each of the layers from the undercoat raw material layer 130 to the third raw material layer 133 can be formed using a plating method. Examples of the plating method include electroplating, non-electrolytic plating, and hot-dip plating. Each of the layers can be formed under known plating treatment conditions.

(Step S2)

The thermal treatment is performed for a predetermined retention time at a thermal treatment temperature that is at least the melting point of Sn. The thermal treatment temperature is the temperature of the raw material 10. The retention time is a period of time for which the temperature of the raw material 10 is retained at the thermal treatment temperature. Through this thermal treatment, Sn in a liquid phase state appropriately reacts with Zn and Cu. Through this thermal treatment, it is possible to manufacture the electrical contact material 1 including the above-described coating layer 3 and the oxide layer 4 formed on the surface of the base material 2 in that order from the base material 2 side.

The thermal treatment temperature may be from 232° C. to 500° C. inclusive. If the thermal treatment temperature is at least 232° C., it is possible to cause Sn to enter the liquid phase state, and facilitate the formation of the oxide layer 4 having a small Cu content, a large Sn content, and a large Zn content, at the outermost surface of the electrical contact material 1. If the thermal treatment temperature is not higher than 500° C., diffusion of Cu toward the surface of the coating layer 13 is likely to be suppressed. The thermal treatment temperature may be preferably from 240° C. to 450° C. inclusive, and more preferably from 250° C. to 400° C. inclusive.

The retention time may be from 1 second to 5 minutes inclusive. If the retention time is at least 1 second, it is possible to cause Sn to enter the liquid phase state, and facilitate the formation of the oxide layer 4 having a small Cu content, a large Sn content, and a large Zn content, at the outermost surface of the electrical contact material 1. If the retention time is not longer than 5 minutes, diffusion of Cu toward the surface of the coating layer 13 is likely to be suppressed. The retention time may be preferably from 2 seconds to 4 minutes inclusive, and more preferably from 3 seconds to 3 minutes inclusive.

The thermal treatment may be performed in an oxygen atmosphere.

[Functions and Effects]

The electrical contact material 1 according to the present embodiment can be used over a long period of time because the electrical contact material 1 has good heat resistance as a result of the undercoat layer 30 being sufficiently thick and the first layer 31 containing the specific four elements. Furthermore, if the second layer 32 is thin, the electrical contact material 1 according to the present embodiment also has good wear resistance. In particular, the electrical contact material 1 according to the present embodiment has good wear resistance over a long period of time.

Embodiment 2

[Wire Harness]

The electrical contact material 1 according to Embodiment 1 is favorably applicable to a terminal fitting. Examples of terminal fittings to which the electrical contact material is favorably applicable include a terminal fitting included in a connector, a terminal fitting included in a wire harness, and a terminal fitting of a connector included in a wire harness. In Embodiment 2, a wire harness 100 that includes an electrical wire 300 and a terminal fitting 200 will be described with reference to FIG. 3 as an example in which the electrical contact material 1 according to Embodiment 1 is applied to a terminal fitting.

The electrical wire 300 includes a conductor 310 and an insulating layer 320 that covers an outer periphery of the conductor 310. A known electrical wire can be used as the electrical wire 300.

The terminal fitting 200 includes a wire barrel portion 210, an insulation barrel portion 220, and a fitting portion 230. The wire barrel portion 210, the insulation barrel portion 220, and the fitting portion 230 are formed continuously to each other. The insulation barrel portion 220 is provided on one side of the wire barrel portion 210, and the fitting portion 230 is provided on the other side of the wire barrel portion 210.

The wire barrel portion 210 is a conductor connection portion for connecting the conductor 310 of the electrical wire 300. The wire barrel portion 210 includes a pair of crimping pieces for crimping the conductor 310. The insulation barrel portion 220 crimps the insulating layer 320 of the electrical wire 300. The fitting portion 230 is of a female type in the present embodiment and includes a tubular box portion 231 and elastic pieces 232 and 233 that are arranged opposite to each other on the inner surface of the box portion 231. At least one of the elastic pieces 232 and 233 is constituted by the electrical contact material 1 according to Embodiment 1.

A male-type fitting portion is inserted into the box portion 231 of the female-type fitting portion 230. Illustration of the male-type fitting portion is omitted. The male-type fitting portion is firmly held under the biasing force of the elastic pieces 232 and 233 of the female-type fitting portion 230. The female-type terminal fitting 200 and a male-type terminal fitting are electrically connected to each other. The electrical contact material 1 can suppress an increase in the contact resistance even if the pressure of contact with a counterpart material is small, and accordingly, is favorably applicable to a terminal fitting 200 that includes small elastic pieces 232 and 233.

[Functions and Effects]

The wire harness 100 according to the present embodiment has good electrical conductivity over a long period of time. This is because at least one of the elastic pieces 232 and 233 of the female-type fitting portion 230 is constituted by the electrical contact material 1 that can be used for a long period of time. Accordingly, the female-type fitting portion 230 and a male-type fitting portion can be favorably electrically connected to each other over a long period of time.

TEST EXAMPLE

In a test example, electrical contact materials were manufactured and the contact resistance of each electrical contact material was measured.

[Samples No. 1 to No. 3]

An electrical contact material of each sample was manufactured through a step for preparing a raw material and a step for performing thermal treatment on the raw material similarly to the above-described manufacturing method.

[Preparation of Raw Material]

The raw material was prepared by providing, on a surface of a base material, a coating layer that had a four-layer structure constituted by an undercoat raw material layer, a first raw material layer, a second raw material layer, and a third raw material layer that were arranged in that order from the base material side along a thickness direction of the base material.

A metal plate made of a Cu alloy was used as the base material.

Each raw material layer was formed using an electroplating method.

A pure Ni-plated layer was formed as the undercoat raw material layer. Through component analysis performed using an EDX apparatus (manufactured by Carl Zeiss AG), it was confirmed that elements other than Ni were not contained in the undercoat raw material layer. The thickness of the undercoat raw material layer was set to 1.5 μm as shown in Table 1.

A pure Sn-plated layer was formed as the first raw material layer. The thickness of the first raw material layer was selected from 1.0 μm to 2.0 μm as shown in Table 1.

A pure Zn-plated layer was formed as the second raw material layer. The thickness of the second raw material layer was set to 0.2 μm as shown in Table 1.

A pure Cu-plated layer was formed as the third raw material layer. The thickness of the third raw material layer was set to 0.2 μm as shown in Table 1.

[Thermal Treatment]

Thermal treatment was performed on each raw material by heating the raw material so that the raw material had a temperature of 270° C. Each raw material was retained at this temperature for 3 minutes. Heating was performed in an oxygen atmosphere. After the retention time elapsed, the obtained electrical contact material was cooled to normal temperature.

[Sample No. 101]

An electrical contact material of Sample No. 101 was manufactured similarly to Sample No. 2 except that the thickness of the undercoat raw material layer was set to 0.5 μm and the third raw material layer was not provided as shown in Table 1 in the step for preparing a raw material. In Table 1, "-" indicates that the third raw material layer was not provided.

TABLE 1

| Sample No. | Raw material (before thermal treatment) Coating layer: Undercoat raw material layer Ni-plated layer Thickness (μm) | First raw material layer Sn-plated layer Thickness (μm) | Second raw material layer Zn-plated layer Thickness (μm) | Third raw material layer Cu-plated layer Thickness (μm) |
|---|---|---|---|---|
| 1 | 1.5 | 1.0 | 0.2 | 0.2 |
| 2 | 1.5 | 1.5 | 0.2 | 0.2 |
| 3 | 1.5 | 2.0 | 0.2 | 0.2 |
| 101 | 0.5 | 1.5 | 0.2 | — |

[Cross Sectional Observation, Component Analysis]

A cross section of each electrical contact material was observed and components of the coating layer provided on the surface of the base material were analyzed. The cross section was taken along the thickness direction of the base material. The cross section was observed using an SEM. The components were analyzed using the above-described EDX apparatus. The acceleration voltage of the EDX apparatus was set to 15 kV. As a result, it was found that, in the electrical contact material, a coating layer including four layers of an undercoat layer, a first layer, a second layer, and an oxide layer arranged in that order from the base material side was formed on the surface of the base material. Specifically, it was found that the undercoat layer contained Ni. The undercoat layer also contained Zn, Cu, and Sn, in addition to Ni. It was found that the first layer contained Ni, Zn, Cu, and Sn. It was found that the second layer contained Sn. The second layer also contained Ni, Zn, and Cu, in addition to Sn. It was found that the oxide layer was constituted by an oxide containing Zn, Cu, and Sn. The oxide layer did not contain metal elements other than Zn, Cu, and Sn. Contents of Ni, Zn, Cu, and Sn contained in the first layer are shown in Table 2. Also, with respect to Samples No. 1 to No. 3, contents of Ni, Zn, Cu, and Sn contained in the second layer are shown in Table 2. The contents of the elements contained in the first layer and the second layer shown in Table 2 are values when the total content of C, O, Ni, Zn, Cu, and Sn was 100 atom %.

[Measurement of Thickness]

The thickness of each layer was determined as follows. A cross section was taken along the layered direction of the coating layer. Two backscattered electron images were taken from the cross section using an SEM. The size of each backscattered electron image was set to 30 μm×40 μm. In each backscattered electron image, the length of each layer along the layered direction of the coating layer was measured at least five positions. An average of the measured lengths of the undercoat layer, an average of the measured lengths of the first layer, an average of the measured lengths of the second layer, and an average of the measured lengths of the oxide layer were calculated. The averages were taken to be the thicknesses of the respective layers. The thicknesses of the respective layers in the electrical contact materials of Samples No. 1 to No. 3 and No. 101 are shown in Table 2.

[Measurement of Contact Resistance]

As the contact resistance of each electrical contact material, (1) an initial contact resistance, (2) a contact resistance after an accelerated aging test, and (3) a contact resistance after a sliding test were measured, Results of the measurement are shown in Table 3.

Each contact resistance was measured using a four-terminal sensing resistance measurement device by bringing a gold-plated spherical indenter with a radius of 1 mm into contact with the oxide layer of the electrical contact material while applying a load of 1 N. The purity of gold used for plating was substantially K24. The thickness of the gold plating was 0.4 μm.

(1) The initial contact resistance was the contact resistance of the electrical contact material at normal temperature after subjected to the above-described thermal treatment and before subjected to an accelerated aging test and a sliding test described below.

(2) The accelerated aging test was performed by leaving the electrical contact material to stand in an atmosphere at 160° C. for 120 hours. A contact resistance of the electrical contact material that was cooled to normal temperature after the accelerated aging test was taken to be the contact resistance after the accelerated aging test.

(3) The sliding test was performed by linearly sliding the above-described indenter against the oxide layer of the electrical contact material. A load of 1 N was applied via the indenter. The sliding speed was set to 100 μm/sec. The stroke was set to 50 μm. The number of reciprocation cycles was set to 100. The contact resistance was measured after each reciprocation cycle. The number of measurements (N number) was two. Table 3 shows, as contact resistances after the sliding test, an average of the largest contact resistances measured after the first to 10th reciprocation cycles and an average of the largest contact resistances measured after the first to 100th reciprocation cycles.

TABLE 2

| Sample No. | Electrical contact material (after thermal treatment) Coating layer: Undercoat layer Thickness (μm) | First layer Ni (atom %) | First layer Zn (atom %) | First layer Cu (atom %) | First layer Sn (atom %) | First layer Thickness (μm) | Second layer Ni (atom %) | Second layer Zn (atom %) | Second layer Cu (atom %) | Second layer Sn (atom %) | Second layer Thickness (μm) | Oxide layer Thickness (μm) |
|---|---|---|---|---|---|---|---|---|---|---|---|---|
| 1 | 1.3 | 18.71 | 10.99 | 22.67 | 33.9 | 1.59 | 6.88 | 4.28 | 9.07 | 61.01 | 0.13 | 0.04 |
| 2 | 1.3 | 20.07 | 12.71 | 18.36 | 35.29 | 1.62 | 4.11 | 4.05 | 6.78 | 53.33 | 0.27 | 0.04 |
| 3 | 1.3 | 19.51 | 11.98 | 19.59 | 35.47 | 2.00 | 3.44 | 1.31 | 3.80 | 64.43 | 0.54 | 0.04 |
| 101 | 0.3 | 26.03 | 17.85 | 3.49 | 36.63 | 1.15 | 2.49 | 3.00 | 3.93 | 60.79 | 0.27 | 0.04 |

TABLE 3

| | Contact resistance | | | |
|---|---|---|---|---|
| | | After accelerated | After sliding test | |
| Sample No. | Initial (mΩ) | aging test (mΩ) | 1-10 cycles (mΩ) | 1-100 cycles (mΩ) |
| 1 | 2.6 | 3.2 | 1.4 | 3.7 |
| 2 | 3 | 3.8 | 2.2 | 10.7 |
| 3 | 2.8 | 3.8 | 5.2 | 11.8 |
| 101 | 1.95 | 814.8 | 3.05 | 6.12 |

As shown in Table 3, each of the electrical contact materials of Samples No. 1 to No. 3 had a low initial contact resistance as well as a low contact resistance after the accelerated aging test. Specifically, the initial contact resistance was not larger than 3 mΩ. The contact resistance after the accelerated aging test was not larger than 4 mΩ. From these results, it was found that the electrical contact materials of Samples No. 1 to No. 3 had good heat resistance.

Furthermore, each of the electrical contact materials of Samples No. 1 and No. 2 also had a low contact resistance after the sliding test. Specifically the largest contact resistance measured after the first to 10th reciprocation cycles was not larger than 5 mΩ, not larger than 3 mΩ, and not larger than 2.5 mΩ. In particular, as for the electrical contact material of Sample No. 1, the largest contact resistance measured after the first to 100th reciprocation cycles was not larger than 5 mΩ, not larger than 4.5 mΩ, and not larger than 4.0 mΩ. From these results, it was found that the electrical contact materials of Samples No. 1 and No. 2 had good wear resistance, in particular, the electrical contact material of Sample No. 1 had good wear resistance.

The electrical contact material of Sample No. 101 had a low initial contact resistance, but had a high contact resistance after the accelerated. aging test. Specifically the initial contact resistance was 1.95 mΩ, but the contact resistance after the accelerated aging test was 814.8 mΩ. From these results, it was found that the electrical contact material of Sample No. 101 had poor heat resistance. As for the electrical contact material of Sample No. 101, the largest contact resistance measured after the first to 10th reciprocation cycles was 3.05 mΩ. As for the electrical contact material of Sample No. 101, the largest contact resistance measured after the first to 100th reciprocation cycles was 6.12 mΩ.

The present invention is defined by the terms of the claims, but not limited to the above description, and is intended to include any modifications within the meaning and scope equivalent to the terms of the claims.

LIST OF REFERENCE NUMERALS

1 Electrical contact material
- 2 Base material
- 3 Coating layer
- 30 Undercoat layer
- 31 First layer
- 32 Second layer
- 4 Oxide layer

10 Raw material
- 12 Base material
- 13 Coating layer
- 130 Undercoat raw material layer
- 131 First raw material layer
- 132 Second raw material layer
- 133 Third raw material layer

100 Wire harness
- 200 Terminal fitting
- 210 Wire barrel portion
- 220 Insulation barrel portion
- 230 Fitting portion
  - 231 Box portion
  - 232, 233 Elastic piece
- 300 Electrical wire
- 310 Conductor
- 320 Insulating layer

What is claimed is:

1. An electrical contact material comprising:
a base material;
a coating layer that is provided on a surface of the base material; and
an oxide layer that is provided on a surface of the coating layer,
wherein the base material contains Cu,
the coating layer includes an undercoat layer, a first layer, and a second layer that are provided in that order from the base material side,
the undercoat layer contains Ni,
the first layer contains Ni, Zn, Cu, and Sn,
the second layer contains Sn,
the oxide layer is constituted by an oxide containing Zn, Cu, and Sn, and
the undercoat layer has a thickness larger than 0.5 μm.

2. The electrical contact material according to claim 1,
wherein contents of Ni, Zn, Cu, and Sn contained in the first layer are such that
Ni is from 15 atom % to 35 atom % inclusive,
Zn is from 5 atom % to 30 atom % inclusive,
Cu is from 1 atom % to 30 atom % inclusive, and
Sn is from 25 atom % to 55 atom % inclusive,
wherein the total content of C, O, Ni, Zn, Cu, and Sn contained in the first layer is 100 atom %.

3. The electrical contact material according to claim 1,
wherein the first layer has a thickness of 0.1 μm to 5.0 μm inclusive.

4. The electrical contact material according to claim 1,
wherein the second layer has a thickness of 0.1 μm to 0.55 μm inclusive.

5. The electrical contact material according to claim 1,
wherein the oxide layer has a thickness of 0.01 μm to 5.0 μm inclusive.

6. A terminal fitting comprising
the electrical contact material according to claim 1.

7. A connector comprising
the terminal fitting according to claim 6.

8. A wire harness comprising:
an electrical wire; and
the terminal fitting according to claim 6 that is attached to the electrical wire.

9. A wire harness comprising:
an electrical wire; and
the connector according to claim 7 that is attached to the electrical wire.

* * * * *